United States Patent [19]

Rathjen et al.

[11] 4,379,742

[45] Apr. 12, 1983

[54] GAS-GENERATING METAL ELECTRODE FOR ELECTROCHEMICAL PROCESSES

[75] Inventors: Hans-Carl Rathjen; Konrad Koziol, both of Röthenbach, Fed. Rep. of Germany

[73] Assignee: Conradty GmbH Co. Metallelektroden KG, Rothenbach, Fed. Rep. of Germany

[21] Appl. No.: 237,279

[22] Filed: Feb. 23, 1981

[30] Foreign Application Priority Data

Mar. 3, 1980 [DE] Fed. Rep. of Germany ..... 3008116

[51] Int. Cl.[3] ..... C25B 11/02; C25B 11/04; C25B 9/00

[52] U.S. Cl. ..... 204/286; 204/288; 204/290 F

[58] Field of Search ..... 204/286, 288, 290 F

[56] References Cited

U.S. PATENT DOCUMENTS 3,409,533 11/1968 Murayama et al. ..... 204/219
3,507,771 4/1970 Donges et al. ..... 204/284
3,839,179 10/1974 Koziol et al. ..... 204/219
3,953,316 4/1976 Baker ..... 204/288
4,022,679 5/1977 Koziol et al. ..... 204/286

FOREIGN PATENT DOCUMENTS 2721958 11/1978 Fed. Rep. of Germany .
1068992 5/1967 United Kingdom .

*Primary Examiner*—F. Edmundson
*Attorney, Agent, or Firm*—Lyon & Lyon

[57] ABSTRACT

A gas-generating metal electrode for electrochemical processes, more particularly, a coated titanium anode for amalgam cells, comprising spaced-apart parallel rods arranged in a horizontal plane, the surfaces of said rods forming the working area of said electrode and the rods each having a cross section whose extent normal to said plane is greater than the extent parallel thereto, characterized in that the cross section of each of said rods consists of a rectangle (1*a*) whose height ($h_R$) is normal to said plane, and at least one chordal segment (1*b*) on one side of the rectangle and whose chord corresponds to the width of said rectangle (1*a*) and which extends between and interconnects the opposite sides of said rectangle (1*a*).

10 Claims, 2 Drawing Figures

GAS-GENERATING METAL ELECTRODE FOR ELECTROCHEMICAL PROCESSES

BACKGROUND OF INVENTION

The present invention relates to a gas-generating metal electrode for electrochemical processes, more particularly a coated titanium anode for amalgam cells consisting of spaced-apart parallel rods arranged in a horizontal plane, the surfaces of which form the working area of the electrode and have a cross section whose extent normal to said plane is greater than the extent parallel thereto.

Gas-generating metal electrodes arranged in a horizontal plane, normally the anode which is placed opposite a counter-electrode likewise arranged in a horizontal plane, normally the cathode, have to meet several criteria:

The first criterion consists in the requirement that the gas generated at the anode be carried away as rapidly as possible. To achieve this, the anode shall have a free area in the horizontal plane of arrangement, that is to say, it shall have openings or the like through which the gas being generated on the lower side of the anode can escape upward. Said free area of the anode shall be as large as possible. Experiments have shown that said free area shall be ≧approximately thirty-three percent (33%) of the projected area of the anode formed by the length times the width of the area occupied by the anode in the horizontal plane. Because the openings which can be made in perforated plates, expanded-metal grids, etc. and which form the free area through which the gas can be conducted away, are inadequate for this purpose, use is made of spaced-apart parallel rods, the upper surfaces of which form the working area of the electrode.

In rods with edged profiles such as, for example, rectangular or triangular profiles, it has been found that greater wear of the rod coating occurred on the edges. Therefore, the second criterion consists in the use of a rod profile having no sharp edges. This condition leads to the use of rods having a circular cross section.

Other conditions have to be observed in addition to the two important criteria mentioned above. One of these other conditions consists in placing the working area of the anode as close to the cathode as possible. The farther the working area of the anode is removed from the cathode, the greater the voltage drop of the cell and, thereby, the energy required for making the desired product. Since the alkali chloride electrolysis according to the amalgam process works with a mercury cathode which, due to the characteristics of the material, cannot be inherently stable and because in the event of a short circuit caused by a deformation of the cathode and resultant contact with the anode due to the high current densities in this process heavy damages arise at the anode, the operation is essentially carried out with an anode/cathode spacing of 3 mm, depending on the current density and on other conditions such as monitoring facilities, etc. Since the portion of the area of the anode running parallel to the cathode shall be minimized in order that the free area for carrying away the gas can be maximized, a portion of the working area shall be normal to the plane of the anode. Experiments have shown that the difference between the nearest and the farthest point of the working area in relation to the cathode shall be 2.0 mm maximum. Thus, in this region the coating shall primarily be deposited on the carrier, i.e., the rods and the like.

Another criterion consists in minimizing the portion of the working area of the anode which, viewed from the cathode, lies in the Stromschatten (lit. "current shadow"). Hence it follows that for the portion of the working area normal to the anode plane the radius of the round rods must be taken into consideration as another limiting value in addition to the above limiting value of 2.0 mm.

It should further be realized that the wear of the coating also depends heavily on the true current density. Therefore, it is necessary to maximize the working area of the anode for a cathode area which is predetermined by the size of the cells. The so-called projection area of the anode is determined by the length and the width of the anode. In most cases it is predetermined by the user, so that little control can be exercised. However, the projected area gives only scant information about the size of the working area of the anode and, thus, about the true current density, but an attempt should be made in any case to obtain a ratio of working area to project area of ≧1.

The above types of metal electrodes or anodes employed heretofore meets these criteria only partly.

Although in contrast to rods with edged profiles, premature wear of the coating is avoided in the already known anodes with round rods, the latter have the drawback that the portion of the working area of the anode substantially normal to the anode plane or parallel to the direction of the main flow of the electric current is relatively small, whereas the portion of the working area of the anode lying in the current shadow (viewed from the cathode) and which therefore is not, or not fully, utilized, is comparatively large. Moreover, the ratio between free and projected area of the anode is unfavorable so that only an inadequate amount of the generated gas is conducted away.

Prior art electrodes or anodes of the above type in which the rods have a rectangular cross section whose height normal to the plane of arrangement of the rods is larger than the width parallel thereto have the main drawback that the coating wears rapidly on the edges, thereby reducing the service life of these electrodes.

THE INVENTION

Therefore, it is an object of the invention to improve the above type of electrode in such a way that it can better meet the conditions outlined above in comparison with prior arrangements and can still be manufactured with ease and at low cost.

In accordance with the present invention, an improved metal electrode is provided by a plurality of rods with the cross section of each being comprised essentially of a rectangle whose height is normal to the plane; and at least one chordal segment having a cord which corresponds to the width of the rectangle and extends between and interconnects the opposite sides of the rectangle. The cross section of each of the rods may be generally described as oval-shaped or as a circle which is flattened on two opposite sides.

The construction of the rods pursuant to the principles of the invention, with an oval-shaped cross section, ensures an increase in the spacing between the individual rods and, thereby, an increase in the free area of the anode, so that the gas generated at the anode during the operation is better discharged in comparison with anodes provided with round rods. The anode embodying the principles of the invention is therefore especially suited to amalgam cells working with comparatively high current values and, thus, with high current density, because the generation of gas, which increases with higher current densities, can be controlled.

Compared with round rods, in the arrangement according to the present invention, the portion of the working area normal to the plane of arrangement of the rods is enlarged and the portion of the working area situated in the current shadow (viewed from the cathode) is reduced.

Compared with electrodes having rectangular rods, the electrodes according to the present invention, have the advantage that the rods have no edges that cause greater wear of the coating.

Normally, the cross section of the rods of the present invention, is formed by a rectangle and two connecting chordal segments. However, it is also conceivable that the cross section consists of a rectangle and only one such segment.

The cross section of the invention can easily be manufactured from round stock, e.g., by a drawing or rolling process. Thus, the profile according to the invention can be made very easily when the segment of the cross section of the rods is a segment of a circle, because in this case, the rounds must be flattened only on two opposite sides.

DRAWINGS

Other objects and advantages of the present invention will become apparent from the following detailed description of a preferred embodiment thereof taken in conjunction with the attached drawings in which:

FIG. 1 is a perspective view of an anode embodying the principles of the present invention in a preferred form; and FIG. 2 shows the detail X of FIG. 1.

DETAILED DESCRIPTION

Figure 1:
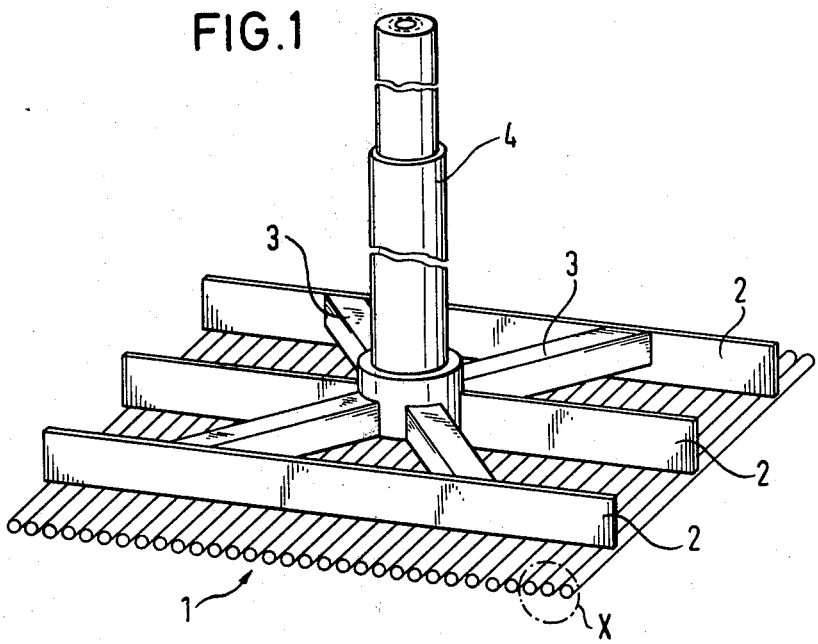

Referring to the drawing in detail, FIG. 1 shows a metal electrode according to the invention comprising a plurality of spaced-apart parallel rods 1 arranged in a horizontal plane. Rods 1 are connected both mechanically and electrically in any suitable manner with spaced-apart parallel current-carrying bars 2 placed at right angles to the surfaces of the rods. Current-carrying bars 2 are connected electrically and, as required, also mechanically to a current-carrying bolt 4 either directly or via cross bars 3 in any conventional fashion.

Figure 2:
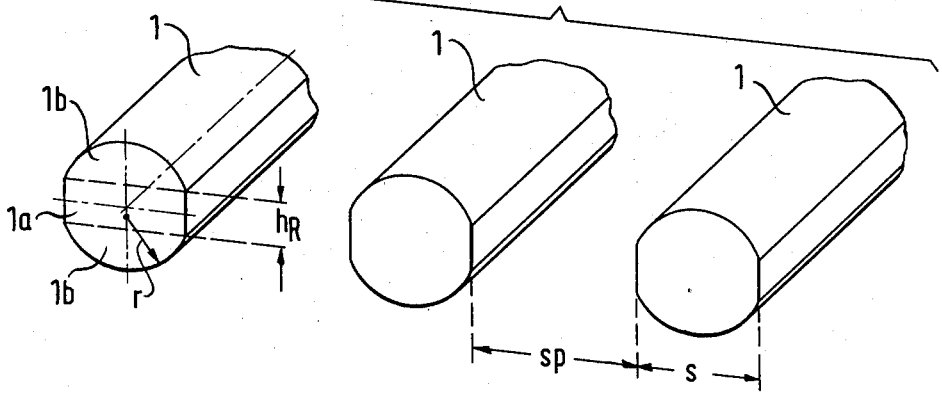

The cross sections of rods 1 and their arrangement in a horizontal plane can best be seen from FIG. 2, in which the cross section of each rod has a height measured in a direction normal to the plane of the rods which height is greater than the extent of the cross section measured in a direction parallel to the plane of the rods. In accordance with the present invention, the cross section of each rod 1 consists of a rectangle 1*a*, whose height $h_R$ is normal to the plane of arrangement of the rods, and two segments 1*b* having chords which correspond to the width of the rectangle and extend between and interconnect the opposite sides ($h_R$) of rectangle 1*a* with the chords forming the opposite, larger sides of the rectangle 1*a*. In other words, the chordal segments 1*b* are located on the opposite, upper and lower, longer sides of the rectangle 1*a* with the chords forming said opposite, upper and lower, longer sides of the rectangle 1*a*. Preferably, segments 1*b* are segments of a circle having a radius r. Although in the preferred embodiment, two chordal segments 1*b* are included in each rod, it is conceivable that the electrode rods of the present invention may also be constituted to include but a single segment 1*b* on one side of rectangle 1*a*.

FIG. 2 also shows that rods have a width s and that they are spaced from one another by a gap width sp.

Experiments have shown that for the oval-shaped profile of the invention, the following dimensioning limits are of advantage:

Height $h_R$ of the rectangle of the cross section $\geqq 1.0$ mm;

Width s of the rod 3.00 mm$\leqq s \leqq$5.55 mm;

Radius r of the segment of a circle 1.62 mm$\leqq r \leqq$5.55 mm.

The table below shows a self-evident comparison between the dimensioning rules between round rods and rods having the profile according to the present invention:

| Round Rods | "Oval" Profils |
|---|---|
| Wire radius [mm] $1.314 \leqq r \leqq 2.1525$ | $1.625 \leqq r \leqq 5.55$ |
| Rod width [mm] $2.628 \leqq s \leqq 4.305$ | $3.0 \leqq s \leqq 5.55$ |
| Gap width [m] $1.5 \leqq sp \leqq 2.283$ | $1.5 \leqq sp \leqq 3.34$ |
| Free area [%] $33.33 \leqq F_{free} \leqq 36.34$ | $33.33 \leqq F_{free} \leqq 52.68$ |
| Area factor [1] $1.0 \leqq F_{A/P} \leqq 1.047$ | $1.0 \leqq F_{A/P} \leqq 1.408$ |

What is claimed is:

1. A gas-generating metal electrode for electrochemical processes, more particularly a coated titanium anode for amalgam cells, comprising spaced-apart parallel rods arranged in a horizontal plane, the surfaces of said rods having a cross section whose height normal to said plane is greater than the width parallel thereto, characterized in that the cross section of each of said rods is comprised of a rectangle whose height is normal to said plane and at least one chordal segment whose chord corresponds to and coincides with the width of said rectangle on one side thereof, said chord extending between and interconnecting two other and opposite sides of said rectangle.

2. An electrode according to claim 1, characterized in that said chordal segment is a segment of a circle.

3. An electrode according to claim 1 or 2, characterized in that the height of said rectangle is at least 1.0 mm.

4. An electrode according to claim 1 characterized in that the width of said rectangle is between 3.00 mm and 5.55 mm.

5. An electrode according to claim 2, characterized in that the radius of said circle is between 1.62 mm and 5.55 mm.

6. An electrode according to claim 1 wherein said chordal segment is a segment of a circle, the height of said rectangle is at least 1.0 mm, and the width of said rectangle is between 3.00 mm and 5.55 mm.

7. An electrode according to claim 6 wherein the radius of said circle is between 1.62 mm and 5.55 mm.

8. A gas-generating metal electrode for electrochemical processes, more particularly a coated anode for amalgam cells, comprising spaced-apart parallel rods arranged in a horizontal plane, the surfaces of said rods forming the working area of said electrode and the rods having a cross section whose height normal to said plane is greater than the width parallel thereto, characterized in that the cross section of each of said rods extending in a plane normal to the said horizontal plane of the rods has a generally oval shape.

9. The electrode defined in claim 8 wherein said generally oval shaped cross section includes a rectangle having upper and lower opposite sides, and two chordal segments on said opposite sides of said rectangle with the segments including chords coinciding with said opposite sides of said rectangle.

10. The electrode defined in claim 9 wherein said chordal segments are segments of a circle.

* * * * *